US008922442B2

(12) United States Patent
Yang et al.

(10) Patent No.: US 8,922,442 B2
(45) Date of Patent: Dec. 30, 2014

(54) LOW-PROFILE MULTIBAND ANTENNA FOR A WIRELESS COMMUNICATION DEVICE

(75) Inventors: Guangli Yang, San Diego, CA (US); Xiaotao Liang, East Northport, NY (US); Mikhail Bruk, Hicksville, NY (US); Dean La Rosa, Bohemia, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 696 days.

(21) Appl. No.: 13/150,754

(22) Filed: Jun. 1, 2011

(65) Prior Publication Data

US 2012/0306707 A1 Dec. 6, 2012

(51) Int. Cl.
*H01Q 21/28* (2006.01)

(52) U.S. Cl.
USPC ..... 343/728; 343/702; 343/745

(58) Field of Classification Search
USPC ..... 343/728, 702, 745
See application file for complete search history.

(56) References Cited

U.S. PATENT DOCUMENTS

2003/0189519 A1* 10/2003 Rutfors et al. ..... 343/702
2004/0090377 A1 5/2004 Dai et al.
2008/0081574 A1 4/2008 Shih et al.
2008/0303731 A1 12/2008 Wu et al.
2009/0046014 A1 2/2009 Wu et al.
2009/0273530 A1* 11/2009 Chi et al. ..... 343/741
2011/0001675 A1 1/2011 Lee
2012/0127048 A1* 5/2012 Chou ..... 343/749

FOREIGN PATENT DOCUMENTS

EP 2048739 A1 4/2009
WO 2005043674 A1 5/2005

OTHER PUBLICATIONS

PCT International Search Report and Written Opinion for Application No. PCT/US2012/038788 dated Aug. 9, 2012.

* cited by examiner

*Primary Examiner* — Karl D Frech

(57) ABSTRACT

A device for wireless communication including a wireless transceiver, a printed circuit board (PCB) coupled to the wireless transceiver, a first antenna and a second antenna. The first antenna is coupled to the PCB at a feed point and grounded at a ground point. The first antenna is a quarter-wavelength antenna communicating signals with the wireless transceiver at a first frequency band. The second antenna is coupled to the first antenna at the feed point and grounded at a further ground point. The second antenna is a half-wavelength antenna communicating signals with the wireless transceiver at a second frequency band.

20 Claims, 4 Drawing Sheets

LOW-PROFILE MULTIBAND ANTENNA FOR A WIRELESS COMMUNICATION DEVICE

BACKGROUND

Many wireless communications devices require the ability to transmit and receive in various frequency bands in order to accommodate users' desire to connect to both newer and older networks, and to networks in different geographic areas, using a single device. In order to facilitate such portability between areas and networks, devices need to include antennas capable of communicating in various frequency bands. In such devices, it is desirable to minimize antenna size and profile while simultaneously maximizing radiation and frequency range.

SUMMARY OF THE INVENTION

A device for wireless communication includes a wireless transceiver, a printed circuit board (PCB) coupled to the wireless transceiver, a first antenna and a second antenna. The first antenna is coupled to the PCB at a feed point and grounded at a ground point. The first antenna is a quarter-wavelength antenna communicating signals with the wireless transceiver at a first frequency band. The second antenna is coupled to the first antenna at the feed point and grounded at a further ground point. The second antenna is a half-wavelength antenna communicating signals with the wireless transceiver at a second frequency band.

An antenna arrangement includes a first antenna adapted to be coupled to a printed circuit board at a feed point and adapted to be grounded at a ground point. The first antenna is a quarter-wavelength antenna adapted to communicate signals in a first frequency band. The antenna arrangement also includes a second antenna adapted to be coupled to the first antenna at the feed point and adapted to be grounded at a further ground point. The second antenna is a half-wavelength antenna adapted to communicate signals in a second frequency band.

A device for wireless communication includes a wireless transceiver and a printed circuit board (PCB) coupled to the wireless transceiver. The device also includes a first antenna capacitively coupled to the PCB at a feed point and grounded at a first ground point. The first antenna is a quarter-wavelength antenna conveying first signals to and from the wireless transceiver. The first signals being signals at a first frequency band. The device also includes a second antenna coupled to the first antenna at the feed point and grounded at one of the first ground point and a second ground point. The second antenna is a half-wavelength antenna communicating second signals with the wireless transceiver. The second signals are signals at a second frequency band. The device also includes a third antenna coupled to the first antenna at the feed point and grounded at a third ground point. The third antenna is a half-wavelength antenna receiving the second signals and third signals. The third signals are signals at a third frequency band. The device also includes one of a filter and a shunt LC circuit coupled between the third antenna and the further ground point filtering the second signals and communicating the third signals with the wireless transceiver.

An antenna arrangement includes a first antenna adapted to be capacitively coupled to a PCB at a feed point and grounded at a first ground point. The first antenna is a quarter-wavelength antenna adapted to communicate at a first frequency band. The antenna arrangement also includes a second antenna coupled to the first antenna at the feed point and adapted to be grounded at one of the first ground point and a second ground point. The second antenna is a half-wavelength antenna adapted to communicate at a second frequency band. The antenna arrangement also includes a third antenna coupled to the first antenna at the feed point and adapted to be grounded at a third ground point. The third antenna is a half-wavelength antenna adapted to receive signals at the second frequency band and signals at a third frequency band. The antenna arrangement also includes one of a filter and a shunt LC circuit coupled between the third antenna and the further ground point filtering signals at the second frequency band and communicating signals at the third frequency band.

DETAILED DESCRIPTION

Figure 1:
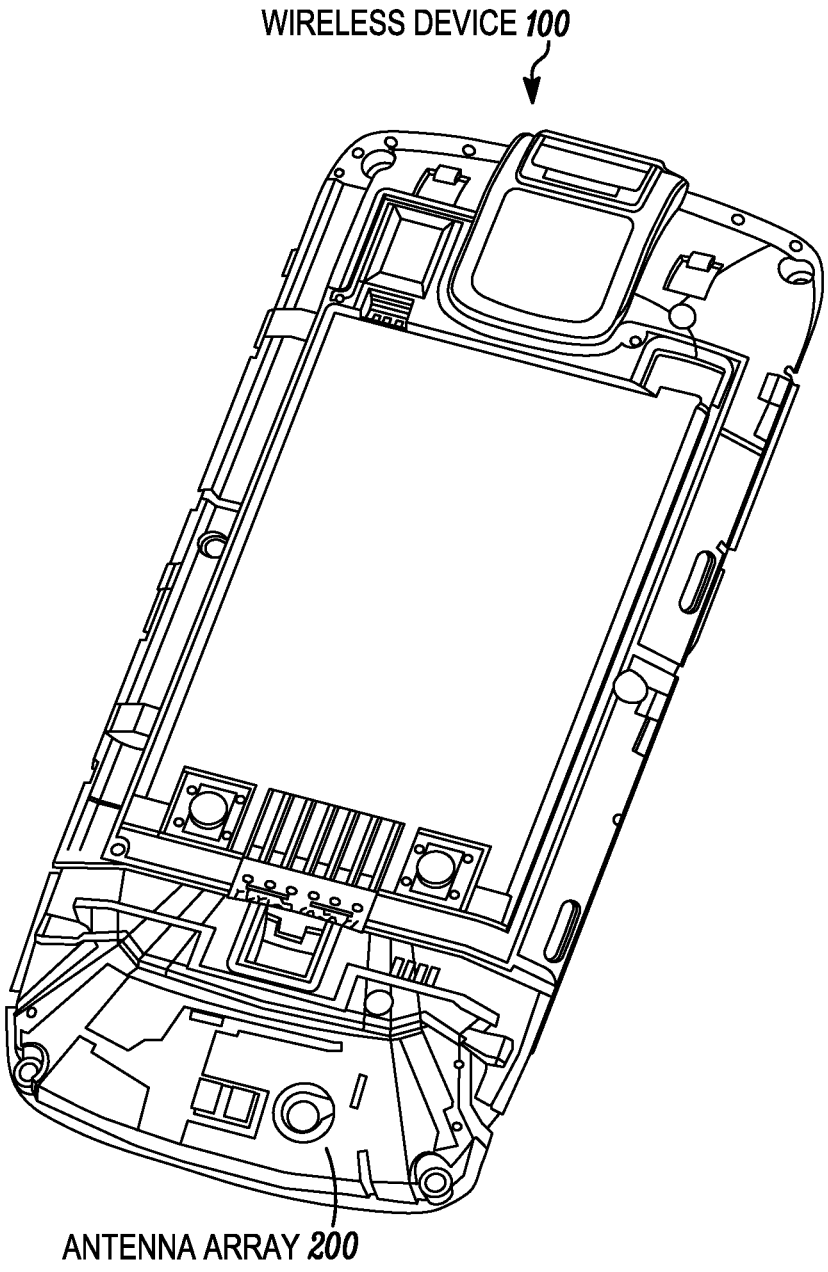
FIG. 1 shows a partial view of a first exemplary embodiment of a wireless communications device including the first exemplary antenna array of FIG. 2 according to the present invention.

The exemplary embodiments of the present invention may be further understood with reference to the following description and the appended drawings, wherein like elements are referred to with the same reference numerals. The exemplary embodiments describe wireless communications devices and antenna arrays for wireless communications devices that provide multi-band communications capabilities.

Users of wireless communications devices (also referred to herein as "wireless devices" or "devices") may wish for such devices to be usable on a variety of wireless communications networks. Varying communications networks may use varying wireless frequency ranges to transmit communications signals; the signals may vary depending on factors including the generation of the network and the geographic area in which the network operates. Such networks may include AMPS and GSM networks in the 824 MHz to 960 MHz range, DCS, PCS and UMTS networks in the 1710 MHz to 2170 MHz range, US LTE networks in the 704 MHz to 798 MHz range, and EU LTE networks in the 2500 MHz to 2690 MHz range. In order for a wireless device to have maximal compatibility with various networks, it may be desirable for the device to include antennas capable of communicating in all of the above frequency ranges. Further, such antennas should maximize efficiency in all such ranges in order to achieve acceptable performance while maintaining energy levels within FCC regulations and maintaining hearing aid compliance.

In order to provide multiband compatibility, prior multiband-capable wireless devices used tunable antennas capable of switching between LTE signals and signals in the 850 MHz frequency band. However, such switches can create harmful harmonics and require additional hardware that may add undesirable size and weight to a wireless device. The exemplary embodiments provide exemplary antenna arrays and exemplary wireless devices using antenna arrays in order to provide multiband compatibility without the use of switching.

FIG. 1 illustrates a first exemplary embodiment of a wireless device 100 according to the present invention. The wireless device 100 includes an antenna array 200 that will be described below with reference to FIG. 2. The wireless device 100 may also include other elements of a wireless communication device (e.g., transceiver, memory, processor, display, user interface, etc). Those of skill in the art will understand that the above list is not intended to be exhaustive and that the wireless device 100 may also include any other appropriate components. Through the use of the antenna array 200, the wireless device 100 may be capable of simultaneously communicating in the 704 MHz to 798 MHz, 824 MHz to 960 MHz and 1710 MHz to 2170 MHz frequency bands.

Figure 2:
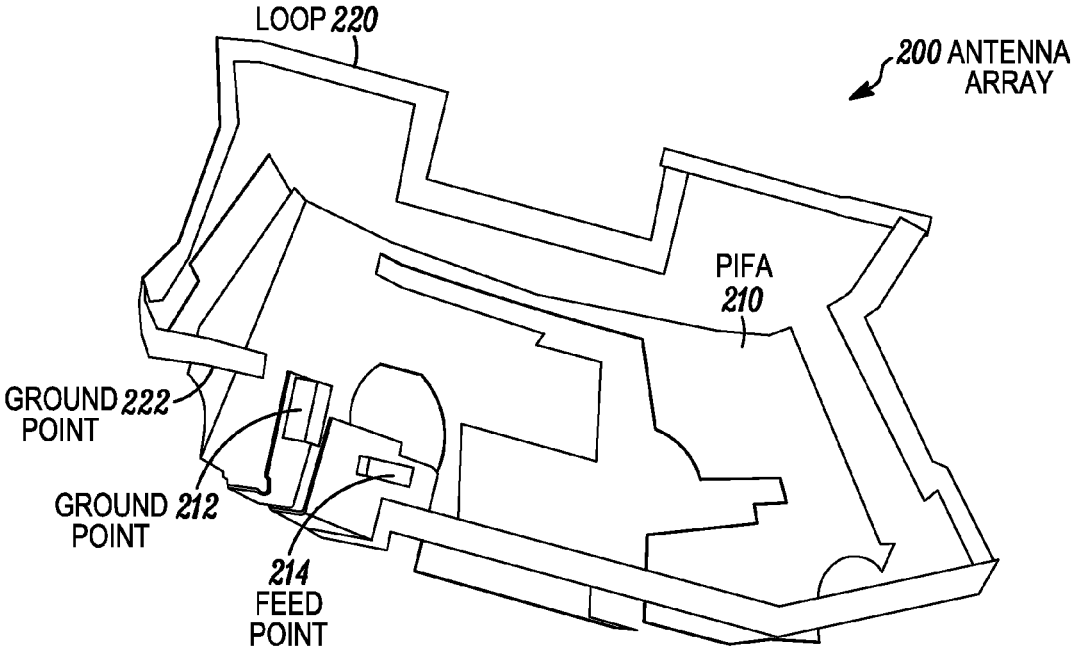
FIG. 2 shows a first exemplary embodiment of an antenna array according to the present invention.

FIG. 2 illustrates a first exemplary embodiment of an antenna array 200 according to the present invention. The antenna array 200 includes a planar inverted F-type antenna ("PIFA") 210. The PIFA 210 may be a quarter-wavelength antenna that may be capable of receiving pentaband (e.g., AMPS, GSM, DCS, PCS and UMTS) signals. Those of skill in the art will understand that the specific shape and contours of the PIFA 210 shown in FIG. 2 are only exemplary, and that various other specific implementations of a PIFA are possible. Further, though the antenna array includes a PIFA 210, other embodiments may include any type of quarter-wavelength antenna capable of receiving the signals described above. The PIFA 210 may include a ground point 212 and a feed point 214, and may be adapted to be supported by an antenna carrier that is, in turn, adapted to be supported by a PCB of a wireless device using the antenna array 200. In another embodiment, the feed point 214 may be a capacitively coupled feed point. Those of skill in the art will understand that a PIFA of an appropriate size to be accommodated within a wireless communications device may typically not be large enough to receive LTE signals.

Therefore, the antenna array 200 also includes a loop antenna 220 providing a further passive radiation mode for the antenna array 200. The loop antenna 220 may be a half-wavelength antenna that may be adapted to receive LTE (e.g., 704 MHz to 798 MHz) signals. Those of skill in the art will understand that the specific size, shape and placement of the loop antenna 220 are only exemplary and that other half-wavelength loop antennas may be equally applicable without departing from the broader principles described herein. The loop antenna 220 may utilize the same feed point 212 used by the PIFA 210, and may include a separate ground point 222. By coupling the PIFA 210 with the loop antenna 220, the antenna array 200 may be capable of simultaneously providing for communication in the 704 MHz to 798 MHz, 824 MHz to 960 MHz and 1710 MHz to 2170 MHz frequency bands. Further, the antenna array 200 may provide such cross-compatibility without the use of a switch to change between LTE signals and other signals, and at energy levels within FCC regulations.

Figure 3:
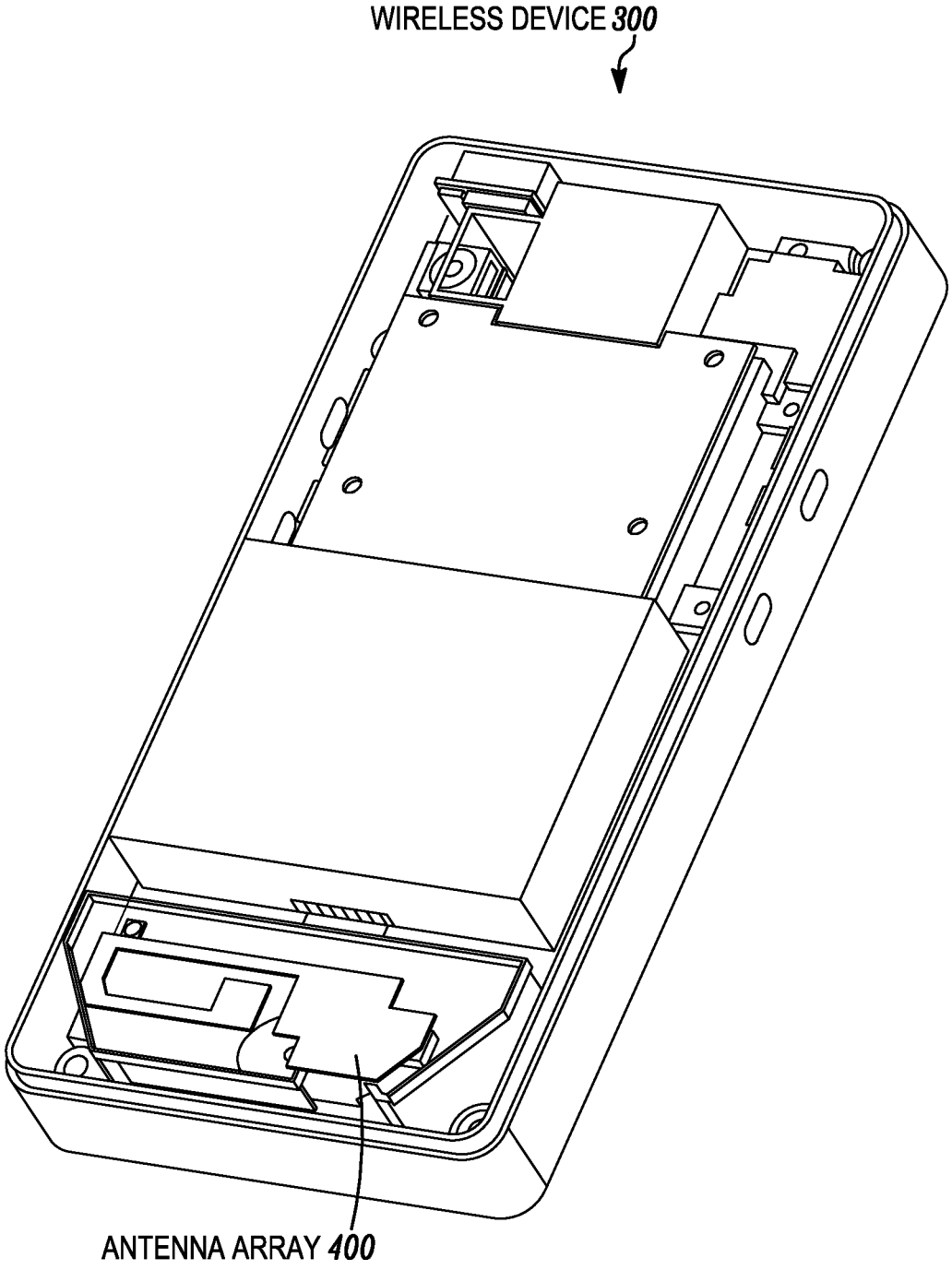
FIG. 3 shows a partial view of a second exemplary embodiment of a wireless communications device including the second exemplary antenna array of FIG. 4 according to the present invention.

FIG. 3 illustrates a second exemplary embodiment of a wireless device 300 according to the present invention. The wireless device 300 includes an antenna array 400 that will be described below with reference to FIG. 4. The wireless device 300 may also include other elements of a wireless communication device (e.g., transceiver, memory, processor, display, user interface, etc). Those of skill in the art will understand that the above list is not intended to be exhaustive and that the wireless device 300 may include any other appropriate components. Through the use of the antenna array 400, the wireless device 300 may be capable of simultaneously communicating in the 704 MHz to 798 MHz, 824 MHz to 960 MHz, 1710 MHz to 2170 MHz and 2500 MHz to 2690 MHz frequency bands.

Figure 4:
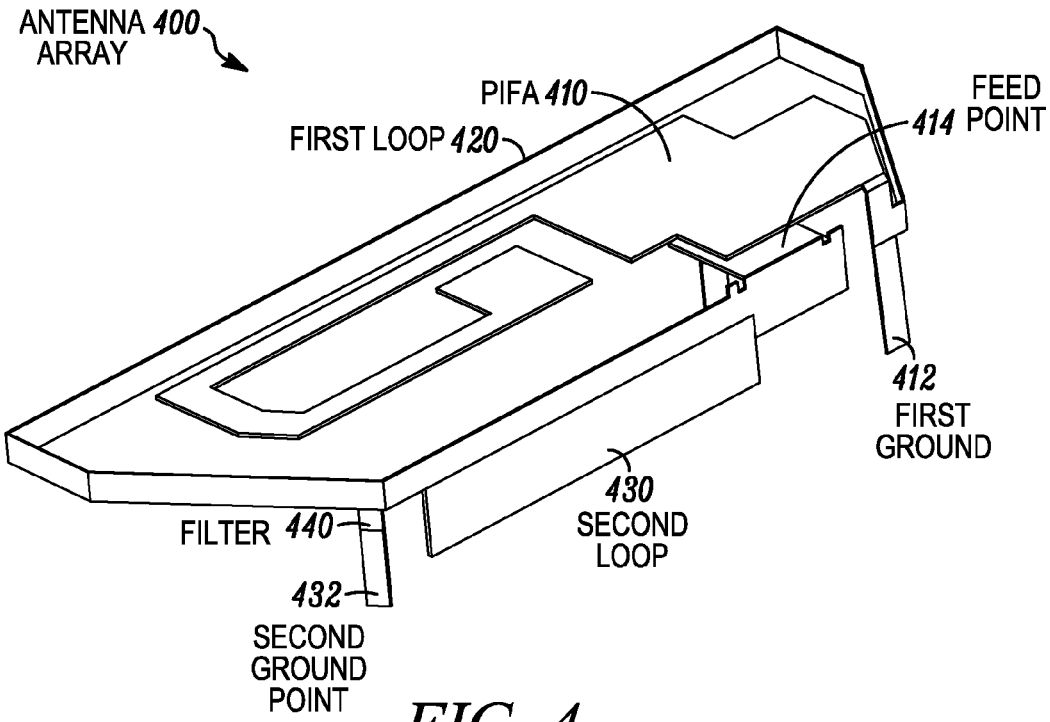
FIG. 4 shows a second exemplary embodiment of an antenna array according to the present invention.

FIG. 4 illustrates a second exemplary embodiment of an antenna array 400 according to the present invention. The antenna array 400 includes a PIFA 410. The PIFA 410 may be a quarter-wavelength antenna that may be capable of receiving pentaband (e.g., AMPS, GSM, DCS, PCS and UMTS) signals. As described above with reference to FIG. 2, those of skill in the art will understand that the specific PIFA 310 shown in FIG. 4 is only exemplary, and that another embodiment may use a different PIFA, or a different type of quarter-wavelength antenna capable of receiving the same signals received by the PIFA 410. The PIFA 410 includes a first ground point 412 and a feed point 414. The feed point 414 of the PIFA 410 may differ from the feed point 214 of the PIFA 210 in that the feed point 414 may be a coupled feed that capactively couples the PIFA 410 with a feed point of a PCB of a wireless device using the antenna array 400. The use of a coupled feed may help to provide additional bandwidth for the antenna array 400 in order to provide improved performance. Those of skill in the art will understand that, in other embodiments, a direct feed may also be used.

The antenna array 400 includes a first loop antenna 420. The first loop antenna 420 may be a half-wavelength antenna that may be adapted to receive low-band LTE (e.g., 704 MHz to 798 MHz) signals. Those of skill in the art will understand that the specific size, shape and placement of the first loop antenna 420 are only exemplary and that other half-wavelength loop antennas may be equally applicable without departing from the broader principles described herein. The first loop antenna 420 may utilize the same first ground point 412 and coupled feed point 414 used by the PIFA 410.

The antenna array 400 also includes a second loop antenna 430. The second loop antenna 430, like the first loop antenna 420, may be a half-wavelength antenna. Those of skill in the art will understand that the specific size, shape and placement of the second loop antenna 430 are only exemplary and that other half-wavelength loop antennas may be equally applicable without departing from the broader principles described herein. The second loop antenna 430 may use a second ground point 432 and the feed point 414. In another embodiment, the first loop antenna 420 may include a second ground point separate from the first ground point 412 and the third loop antenna 430 may include a separate third ground point.

Unlike the first loop antenna 420, the second loop antenna 430 may be adapted to receive high-band LTE (e.g., 2500 MHz to 2690 MHz) signals. Because the second loop antenna 430 may also radiate in the low-band LTE (e.g., 704 MHz to 798 MHz) frequency range, it may be desirable to filter low-band LTE signals from those received by the second loop antenna 430. Therefore, the antenna array 400 may include a filter 440 coupled between the second loop antenna 430 and the second ground point 432 performing such filtering. In another exemplary embodiment, a shunt LC circuit may be used in place of the filter 440.

By coupling the PIFA 410 with the first loop antenna 420 and the second loop antenna 430, the antenna array 400 may be capable of simultaneously providing for communication in the 704 MHz to 798 MHz, 824 MHz to 960 MHz, 1710 MHz to 2170 MHz and 2500 MHz to 2690 MHz frequency bands. Further, the antenna array 400 may provide such cross-compatibility without the use of a switch to change between LTE signals and other signals, and at energy levels within FCC regulations.

Figure 5:
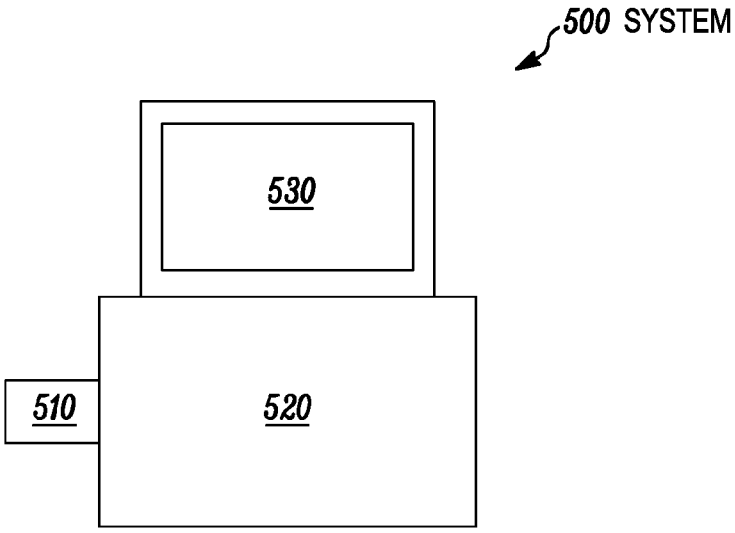
FIG. 5 shows an exemplary embodiment of a system including an antenna array such as those of FIG. 2 or 4 according to the present invention.

FIG. 5 illustrates an exemplary embodiment of a system 500 according to the present invention. The wireless device includes a peripheral wireless device 510, which may include an antenna array such as the antenna array 200 or the antenna array 400 as described above, as well as an appropriate wireless transceiver. The wireless device 510 may be coupled to a computing system 520 including a display 530 in order to provide wireless communication capability to the computing system 520. The computing system 520 may be, for example, a stationary desktop computer, a notebook computer, a tablet computer, a mobile computing device, or any other type of computing system to which a user may wish to add wireless communications capabilities as described above. In one exemplary embodiment, the wireless device 510 may be detachably coupled to the computing system 520 using a universal serial bus (USB) connection, but those of skill in the art will understand that other coupling means are possible without departing from the broader spirit of the exemplary embodiments.

Thus, those of skill in the art will understand that the exemplary embodiments described herein may provide wireless communications devices to communicate in multiple frequency bands using only passive antenna arrays. The exemplary embodiments may also accomplish such frequency breadth without the use of a switch to access LTE band frequencies, and may do so while limiting energy radiated to within FCC regulations.

It will be apparent to those skilled in the art that various modifications may be made in the present invention, without departing from the spirit or the scope of the invention. Thus, it is intended that the present invention cover modifications and variations of this invention provided they come within the scope of the appended claims and their equivalents.

What is claimed is:

1. A device for wireless communication, comprising:

a wireless transceiver;

a printed circuit board (PCB) coupled to the wireless transceiver;

a first antenna coupled to the PCB at a feed point and grounded at a ground point, the first antenna being a quarter-wavelength antenna communicating signals with the wireless transceiver at a first frequency band; and a second antenna coupled to the first antenna at the feed point and grounded at a further ground point, the second antenna being a half-wavelength antenna communicating signals with the wireless transceiver at a second frequency band.

2. The device of claim 1, wherein the first antenna is a planar inverted F-type antenna (PIFA), and the second antenna is a loop antenna.

3. The device of claim 1, wherein the first frequency band includes one of AMPS signals, GSM signals, DCS signals, PCS signals and UMTS signals.

4. The device of claim 3, wherein the first frequency band includes one of signals in the range of 824 to 960 MHz and signals in the range of 1710 to 2170 MHz.

5. The device of claim 1, wherein the second frequency band includes LTE signals.

6. The device of claim 5, wherein the second frequency band includes signals in the range of 704 to 798 MHz.

7. The device of claim 1, wherein the first antenna and the second antenna operate simultaneously to communicate signals with the wireless transceiver in the first frequency band and the second frequency band respectively.

8. An antenna arrangement, comprising:

a first antenna coupled to a printed circuit board at a feed point and grounded at a ground point, the first antenna being a quarter-wavelength antenna communicating signals in a first frequency band; and a second antenna coupled to the first antenna at the feed point and grounded at a further ground point, the second antenna being a half-wavelength antenna communicating signals in a second frequency band.

9. The antenna arrangement of claim 8, wherein the first antenna and the second antenna operate simultaneously to communicate signals in the first frequency band and the second frequency band respectively.

10. A device for wireless communication, comprising:

a wireless transceiver;

a printed circuit board (PCB) coupled to the wireless transceiver;

a first antenna capacitively coupled to the PCB at a feed point and grounded at a first ground point, the first antenna being a quarter-wavelength antenna conveying first signals to and from the wireless transceiver, the first signals being signals at a first frequency band;

a second antenna coupled to the first antenna at the feed point and grounded at one of the first ground point and a second ground point, the second antenna being a half-wavelength antenna communicating second signals with the wireless transceiver, the second signals being signals at a second frequency band;

a third antenna coupled to the first antenna at the feed point and grounded at a third ground point, the third antenna being a half-wavelength antenna receiving the second signals and third signals, the third signals being signals at a third frequency band; and one of a filter and a shunt LC circuit coupled between the third antenna and the third ground point filtering the second signals and communicating the third signals with the wireless transceiver.

11. The device of claim 10, wherein the first antenna is a planar inverted F-type antenna (PIFA), and the second antenna and the third antenna are loop antennas.

12. The device of claim 10, wherein the first frequency band includes one of AMPS signals, GSM signals, DCS signals, PCS signals and UMTS signals.

13. The device of claim 12, wherein the first frequency band includes one of signals in the range of 824 to 960 MHz and signals in the range of 1710 to 2170 MHz.

14. The device of claim 10, wherein the second frequency band and the third frequency band include LTE signals.

15. The device of claim 14, wherein the second frequency band includes signals in the range of 704 to 798 MHz.

16. The device of claim 14, wherein the third frequency band includes signals in the range of 2500 to 2690 MHz.

17. The device of claim 10, wherein the first antenna, the second antenna and the third antenna are detachably coupled to the PCB.

18. The device of claim 10, wherein at least two of the first antenna, the second antenna, and the third antenna operate simultaneously to communicate signals with the wireless transceiver in the first frequency band, the second frequency band, and the third frequency band, respectively.

19. An antenna arrangement, comprising:

a first antenna coupled to a printed circuit board at a feed point and grounded at a ground point, the first antenna communicating signals in a first frequency band; and a second antenna coupled to the first antenna at the feed point and grounded at a further ground point, the second antenna communicating signals in a second frequency band.

20. The antenna arrangement of claim 19, wherein the first antenna and the second antenna operate simultaneously to communicate signals in the first frequency band and the second frequency band, respectively.

* * * * *